United States Patent [19]

Carow

[11] Patent Number: 4,813,577

[45] Date of Patent: Mar. 21, 1989

[54] MULTIPLE FLOW DISPENSING CAP

[75] Inventor: Robert N. Carow, Crystal Lake, Ill.

[73] Assignee: Carow International, Inc., Crystal Lake, Ill.

[21] Appl. No.: 164,426

[22] Filed: Mar. 4, 1988

[51] Int. Cl.[4] ..... B67D 3/00

[52] U.S. Cl. ..... 222/486; 222/525; 222/212; 239/327; 239/449

[58] Field of Search ..... 222/212–213, 222/520–525, 531–532, 545–546, 556, 559, 565; 239/327, 390–391, 396, 440–441, 446–449, 456, 541

[56] References Cited

U.S. PATENT DOCUMENTS

| | | | |
|---|---|---|---|
| 195,643 | 9/1877 | Poh et al. | 239/449 |
| 3,217,931 | 11/1965 | Farrar et al. | 222/485 X |
| 3,439,842 | 4/1969 | Stull | 222/525 |
| 4,673,110 | 6/1987 | Workum | 222/211 |

FOREIGN PATENT DOCUMENTS

| | | | |
|---|---|---|---|
| 686 | 6/1978 | European Pat. Off. | 222/521 |
| 2752707 | 3/1979 | Fed. Rep. of Germany | 239/327 |
| 803846 | 10/1936 | France | 222/521 |

*Primary Examiner*—Michael S. Huppert

*Attorney, Agent, or Firm*—Kinzer, Plyer, Dorn, McEachran & Jambor

[57] ABSTRACT

A dispensing cap for a container, the cap being of the type which has a movable spout mounted on a nozzle having outlet passages. The spout is movable between one position in which it blocks flow through the outlet passages and another position in which it permits flow through the outlet passages. The improvement involves the additional formation of one or more discharge passages in the nozzle which are not controlled by the spout. Such additional discharge passages may be of the type which provide an angled discharge stream, a high pressure discharge stream, a mechanically broken up spray or a high volume discharge flow. A separate closure member may be provided for the additional discharge passages.

6 Claims, 1 Drawing Sheet

MULTIPLE FLOW DISPENSING CAP

BACKGROUND AND SUMMARY OF THE INVENTION

This invention is concerned with improvements to a dispensing cap of the push pull type in which a movable spout is lifted upwardly to open outlet openings in a tubular nozzle surrounded by the spout to permit flow through the spout discharge opening. The invention may also be used with a dispensing cap in which the spout is threadedly mounted on the tubular nozzle and is opened and closed by rotation.

The standard push pull dispensing cap is constructed so that it can be threaded onto a container, usually a plastic, squeezable container, but, of course, it should be understood and appreciated that such a push pull dispensing cap can also be formed integrally with a squeezable or rigid container.

Conventional push pull dispensing caps rely on slit-type openings in the tubular nozzle having limited flow capacity. Also, since the discharge through these slit-like openings passes first radially into and then axially through the discharge spout, a high pressure spray capacity and directionality of the discharge stream are impossible to obtain. There are products such as toilet bowl cleaners that require a directable stream to permit the product to be deposited on designated areas such as under the toilet bowl lip. Presently, these products are not usually dispensed in the conventional push pull dispenser because of this problem.

There are food products that need to be dispensed in a specific direction, such as liquid margarine to be applied to bread or lemon juice to fish or meat, and many times the user also wishes to discharge larger quantities of these products in cooking, such as by shaking drops or pouring. There are also household chemicals which are used in bathrooms and kitchens where a directionality of the liquid stream is desired. Many times it is also desired that a larger amount of the chemical can be quickly dispensed into a bucket or pail, and this cannot be accomplished with the standard push pull dispensing caps.

Therefore, an object of this invention is a push pull dispensing cap which can also provide directionality of a discharge stream, a fine spray, a high pressure stream or a high volume discharge flow by selective design of the additional discharge passages built into a conventional push pull dispensing cap or by the insertion of a mechanical spray break up unit into one of the discharge passages.

Other objects of this invention may be found in the following specification, claims and drawings.

DESCRIPTION OF THE PREFERRED EMBODIMENTS

Figure 1:
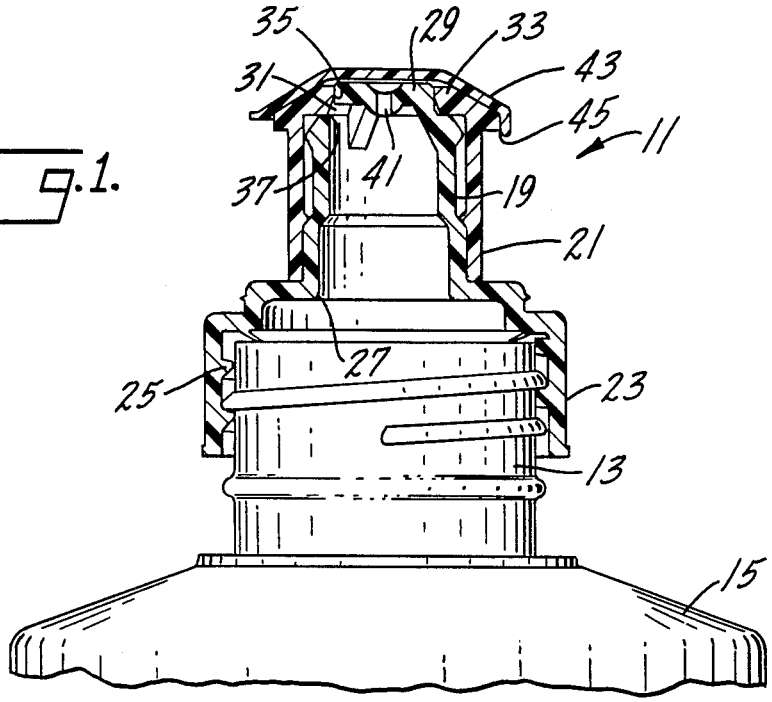
FIG. 1 is an enlarged, side elevational view of a dispensing cap of this invention mounted on a conventional, threaded, squeezable bottle, with the dispensing cap shown in cross section for clarity of illustration.

FIG. 1 of the drawings shows a dispensing cap 11 of this invention mounted on a threaded outlet 13 of a conventional, squeezable, plastic bottle 15. Although the dispensing cap is depicted having threads which engage the threaded outlet 13 of the plastic bottle 15, it should be understood and appreciated that the dispensing cap may be formed integrally with the plastic container. It should also be understood and appreciated that the container need not be formed of a squeezable plastic but may be formed of any suitable material whether rigid or flexible. As is conventional, the dispensing cap 11 includes a nozzle 19 and a spout 21 which is mounted for reciprocal movement on the nozzle. The nozzle 19, as s conventional, is formed with an integral skirt 23. The skirt 23 has internal threads 25 which engage the threaded outlet 13 of the plastic bottle to mount the dispensing cap on the bottle. As is also conventional, the nozzle 19 is open at one end 27 to provide communication with the plastic bottle 15 and has its other end closed by an end wall 29. Outlet openings 31 in the form of elongated slits are formed in the tubular wall of the nozzle next to the end wall 29.

The spout 21 has an end wall 33 in which is formed a discharge opening 35, with the discharge opening being defined by an inwardly directed annular flange 37. When the spout is in its closed position, as shown in FIG. 1, the end wall 29 of the nozzle is received in the discharge opening 35 so that the inwardly directed flange 37 of the spout closes the outlet openings 31 of the nozzle.

In one of my modifications of the conventional dispensing cap 11, a narrow diameter discharge passage 41 is formed in the end wall 29 of the nozzle. In this example, the passage 41 aligns with the axis of the nozzle 19 to provide a narrow stream discharge through the end wall. To close the narrow diameter discharge opening 41, an overcap 43 is molded integrally with the spout 21 and is attached thereto by what is commonly called a living hinge 45.

Figure 2:
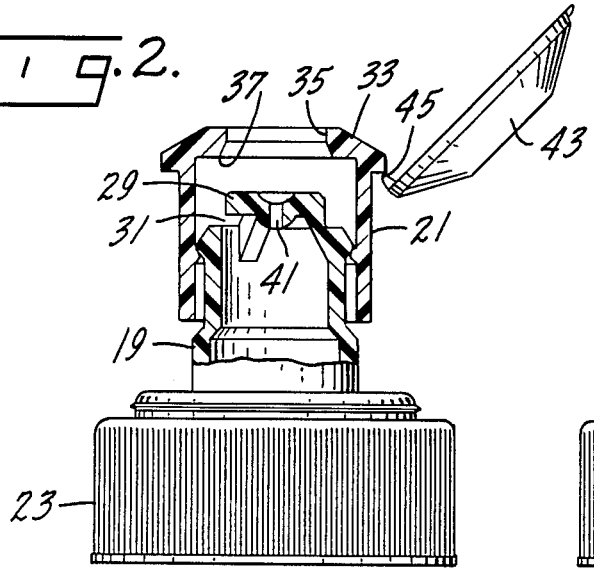
FIG. 2 is side elevational view of the cap of FIG. 1 shown partially in cross section and in its open position, with the overcap shown in its open position.

With the overcap 43 in its open position, as shown in FIG. 2 of the drawings, and the spout 21 in its closed position, as shown in FIG. 1, squeezing of the bottle will cause a high pressure, narrow stream to discharge through the passage 41 in the end wall 29 of the nozzle. There will be n flow through the conventional outlet openings 31 in the nozzle since they will be closed by the flange 37 of the spout 21. If a greater volume of discharge is required, then the spout 21 may be moved to its open position shown in FIG. 2 and squeezing the bottle will cause a higher volume discharge through both the openings 31 in the wall of the nozzle and the narrow diameter discharge passage 41 in the end wall 29 of the nozzle. This higher volume flow through the openings 31 will reduce the pressure of the fluid passing through the passage 41 and will merge with the flow through passage 41 so that rather than a high pressure, narrow jet stream, a higher volume, low pressure flow through all of the openings will be obtained.

Figure 3:
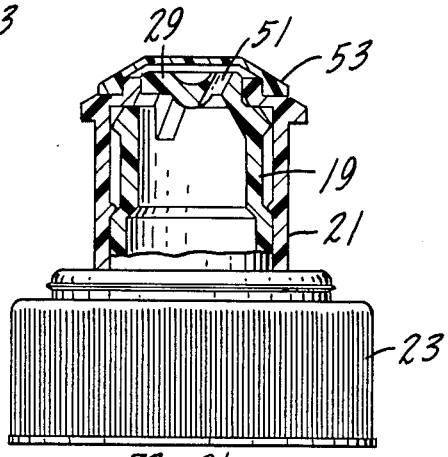
FIG. 3 is a side elevational view partially in cross section of a modified form of the dispensing cap of FIG. 1.

A modified form of the dispensing cap of my invention is shown in FIG. 3 of the drawings in which a narrow diameter discharge passage 51 is formed in the end wall 29 of the nozzle 19. In this embodiment of the invention, the narrow diameter discharge passage is canted or angled relative to the axis of the nozzle 19 to provide a narrow stream discharge which is offset and can be used, for example, as a toilet bowl cleaner. The cap of FIG. 3 provides a narrow, angled stream through passage 51 when the spout 21 is in its closed position, as shown in FIG. 3. When the spout 21 is lifted to its open position, such as the open position of the spout shown in FIG. 2, then a much higher volume flow through the nozzle is obtained, which, in effect, redirects the stream by dampening its velocity and diffusing its direction, thus providing two or more functions for the dispensing cap. It should be noted that in the modification of FIG. 3 an overcap 43 is not provided. Instead, this embodiment of my invention will rely on a simple snap-on or threaded cover 53 to prevent flow through the narrow diameter discharge passage 51. Although there is no reason why an overcap, such as overcap 43, could not be provided, if desired.

Figure 4:
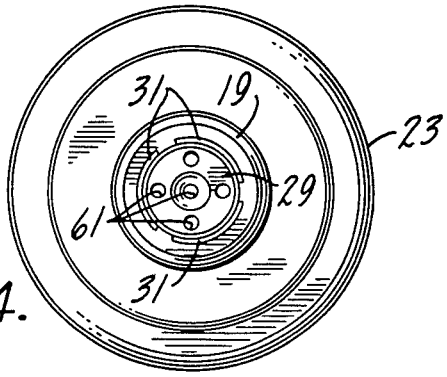
FIG. 4 is a top plan view of yet another modified form of the dispensing cap of FIG. 1.

Yet another modification of my invention is shown in FIG. 4 of the drawings in which a high volume flow is desirable even when the spout 21 is in its closed position. In this modification, a large number of discharge passages 61, in this example five, are formed in the end wall 29. It also should be understood that instead of the five, small diameter discharge passages 61, a single, large discharge passage 61 may be formed in the end wall 29 or less than five passages may be provided. This construction will provide a large volume discharge when the spout is in its closed position, and even a larger volume of discharge when the spout is in its open position by combining the flow through the passages 61 and outlet openings 31. This large volume flow is useful when the user is shaking or pouring from a rigid non-squeezable container.

Figure 5:
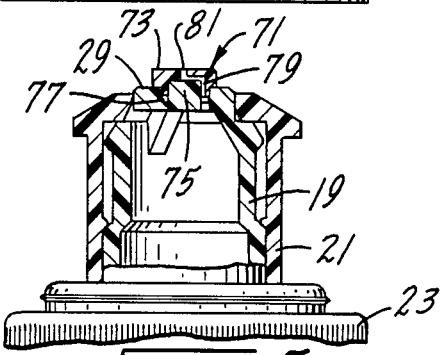
FIG. 5 is a side elevational view partially in cross section of still another modified form of the dispensing cap of FIG. 1 with a mechanical spray break up unit installed.

Still another modification of my invention is shown in FIG. 5 of the drawings in which a fine mist or spray can be obtained when the spout 21 is in its closed position. In this modification, a conventional mechanical break up device 71 is installed in the end wall 29 of the nozzle 19. As is conventional, the mechanical break up device 71 includes a nozzle which is force fitted over a cylindrical mount 75 formed integrally with the end wall 29. The nozzle sits in an annular inlet passage 77 surrounding the cylindrical mount 75 and passages 79 in the nozzle connect the annular inlet passage 77 to a narrow outlet passage 81 in the cap for the fine spray. When the spout 21 is moved to its open position, a large volume, low pressure flow will pass through the openings 31 and the effects of the fine spray will be nullified.

I claim:

1. In a dispensing cap for a container, said dispensing cap being of the type having:

a tubular nozzle having an open end in communication with said container and a wall at the opposite end of the nozzle, outlet opening means for product flow in the tubular nozzle adjacent said end wall, a spout having a discharge opening and being reciprocally mounted on said tubular nozzle for movement between a first position in which the spout coacts with the end wall of the nozzle to prevent flow from the outlet opening means into and through the spout to its discharge opening and a second position in which the spout is located away from the end wall to allow flow from the outlet opening means through the spout and out its discharge opening, the improvement comprising:

at least one passage which does not coact with said spout and is formed in the end wall of the tubular nozzle and an openable closure means mounted on said dispensing cap to control flow through said spout.

2. The dispensing cap of claim 1 in which a plurality of passages are formed in the end wall of the tubular nozzle.

3. The dispensing cap of claim 2 in which the total size of the end wall passages is much larger than the combined size of the outlet openings.

4. The dispensing cap of claim 1 in which the direction of discharge of the end wall passage is angled relative to the axis of the tubular nozzle.

5. The dispensing cap of claim 1 in which the openable closure member is mounted on the movable spout.

6. The dispensing cap of claim 1 in which a mechanical spray break up device is installed in said one passage formed in the end wall of the tubular nozzle.

* * * * *